United States Patent [19]

Molins

[11] 4,040,430

[45] Aug. 9, 1977

[54] METHOD AND APPARATUS FOR MAKING FILTER CIGARETTES

[75] Inventor: Desmond Walter Molins, London, England

[73] Assignee: Molins Limited, England

[21] Appl. No.: 687,744

[22] Filed: May 18, 1976

[30] Foreign Application Priority Data

May 20. 1975 United Kingdom ..... 21365/75
Aug. 22, 1975 United Kingdom ..... 34888/75

[51] Int. Cl.[2] ..... A24C 5/58
[52] U.S. Cl. ..... 131/94
[58] Field of Search ..... 131/58, 94, 72, 29, 131/27 R, 28, 61 R, 71, 76, 88; 198/20 C, 25

[56] References Cited

U.S. PATENT DOCUMENTS

| | | | |
|---|---|---|---|
| 3,176,694 | 4/1965 | Kaeding | 131/94 |
| 3,306,306 | 2/1967 | Rudszinat | 131/94 |
| 3,625,103 | 12/1971 | Giatti | 131/94 |
| 3,815,612 | 6/1974 | Molins | 131/94 |

FOREIGN PATENT DOCUMENTS

| | | | |
|---|---|---|---|
| 1,088,503 | 10/1967 | United Kingdom | 131/94 |

*Primary Examiner*—Stephen C. Pellegrino
*Attorney, Agent, or Firm*—Craig & Antonelli

[57] ABSTRACT

Filter cigarettes are produced by delivering individual filter portions to corresponding ends of each of two rows of staggered tobacco sections as delivered by the catcher drum of a cigarette making machine. The tobacco sections and filter portions of each row are preferably rolled separately (e.g. by parallel ring tipping operations) and subsequently the rows are combined, without any tip turner or final cut. The filter portions may be delivered to take up their staggered formation by feeding pneumatically in an axial direction, or, in a process especially suitable for Russian cigarettes having filter portions consisting of tubular mouthpieces, by transverse movement and alignment.

17 Claims, 13 Drawing Figures

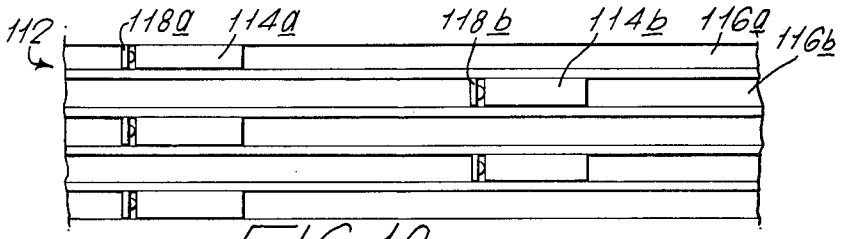
FIG. 10.
FIG. 11.
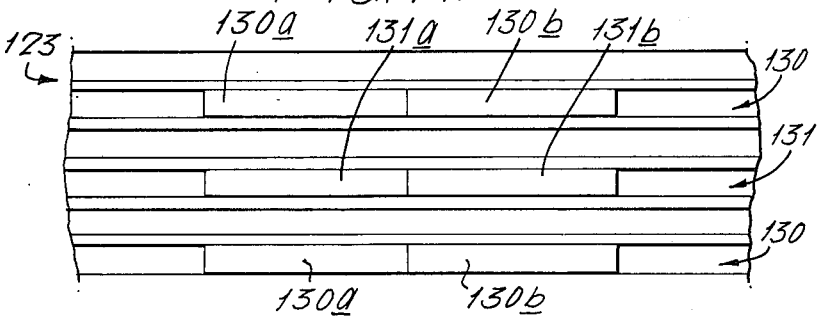
FIG. 12.
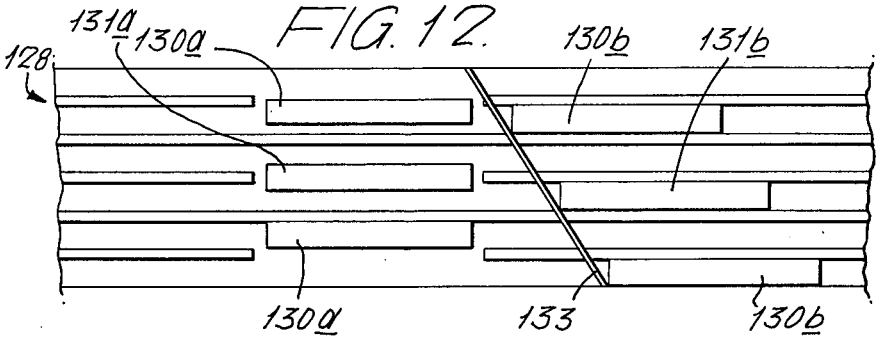
FIG. 13.
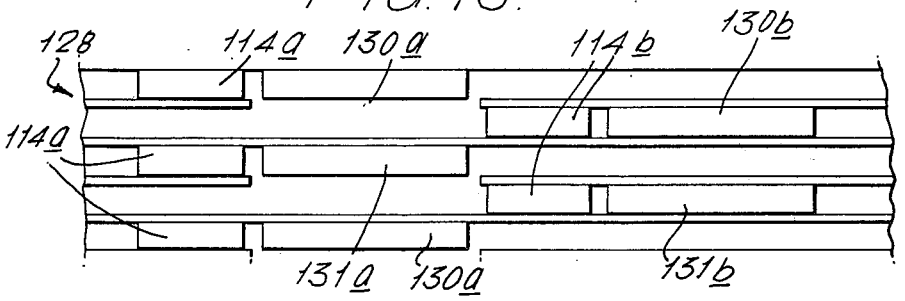

METHOD AND APPARATUS FOR MAKING FILTER CIGARETTES

This invention relates to the manufacture of filter-tipped cigarettes having a filter portion united to a tabacco section. The term "filter" is intended to include any mouthpiece which may be attached to the tabacco section to produce a tipped cigarette, and is not limited to mouthpieces which actually provide a filtering action. For example, a filter portion could consist of a tube, as in a Russian cigarette.

In a conventional way of making filter cigarettes a double length filter portion is placed in line between two tobacco sections and joined to them by rolling in a wrapper section which spans the length of the filter portion and overlaps onto the tobacco sections. Individual filter cigarettes are obtained by cutting the resulting assemblage at its mid-point. Apparatus for producing filter cigarettes in this manner is described for example in British Patent Specification No. 886,657.

It has already been proposed to use, instead of the wrapper section, a pair of encircling uniting bands which overlap the adjacent end portions only of the filter portion and tobacco sections. Apparatus for producing filter cigarettes in this manner is described for example in British Patent Specification No. 1,019,092. Methods of producing filter cigarettes using a uniting band which overlaps only the adjacent end portions of the filter portion and the tobacco section are commonly referred to as ring tipping.

According to the present invention a method of making filter cigarettes includes the steps of assembling tobacco sections moving in a direction transverse to their lengths along two separate paths, the tobacco sections on one path being parallel to and transversely displaced relative to the tobacco sections on the other path; assembling filter portions moving in a direction transverse to their lengths along separate paths, the filter portions on on path being parallel to and transversely displaced relative to the filter portions on the other path; moving said tobacco sections and said filter portions along portions of said separate paths which are common, so as to produce two rows of transversely-moving tobacco sections having axially adjacent filter portions, the filter portions being at the same end of the tobacco sections in each row in relation to the direction of movement of the rows; and uniting the axially adjacent filter portions and tobacco sections whilst they are moving transverse to their lengths. After uniting the rows may be combined into a single row.

The tobacco sections and filter portions are preferably united by means of a rolling ring tipping method using uniting bands obtained by longitudinally slitting and spacing a single web, substantially as disclosed in U.S. patent application Ser. No. 672,148, to which reference is directed in its entirety.

In one embodiment the present invention takes advantage of the fact that tobacco sections are received in axially and transversely offset positions in the flutes of a catcher drum of a cigarette making machine. The filter portions may be assembled in corresponding axially and transversely offset positions by moving them axially by predetermined different distances in alternate flutes of another drum. For example, in a preferred arrangement filter portions are blown into the flutes of a drum by compressed air and take up positions determined by stops in the flutes. The drum in which the filter portions are assembled may be a drum to which the tobacco sections are transferred from the catcher drum, or it may be the catcher drum itself, the filter portions being delivered to the drum by axial movement from the opposite end of the drum to the tobacco sections.

Instead of assembling the filter portions by moving them axially a different method may be used, which method is particularly, but not exclusively, suitable for filter portions in the form of tubular mouthpieces such as those used in Russian cigarettes or papirosi. Accordingly, the axially and transversely offset filter portions on said separate paths are assembled by transversely feeding double length filter portions, dividing said portions at their mid-points to produce pairs of aligned filter portions, rolling or otherwise transversely displacing corresponding filter portions of each pair, preferably through a distance of half the spacing between successive pairs, and axially moving corresponding filter portions of each pair. The filter portion of a pair which is moved axially is preferably not the one which is rolled. The double length filter portions may be fed from two separate sources onto separate conveyors on which they are divided, and subsequently they may be delivered into alternate carriers on a transfer conveyor.

The method whereby filter portions are delivered into positions determined by stops in the flutes of a drum by conveying them along the flute by means of pressure air can be applied to other arrangements for making filter cigarettes. For instance double length filter portions can be supplied in this way to the catcher drum and an aligned assembly comprising a double length filter portion between two tobacco sections can be obtained by rolling back the tobacco sections of one row in a subsequent cigarette aligning drum. The assembly can then be united using a conventional rolling operation or by ring tipping.

The invention will now be further described, by way of example only, with reference to the accompanying drawings in which:

FIGS. 10 to 13 are respective plan views of parts of fluted drums in the apparatus of FIG. 9.

Figure 1:
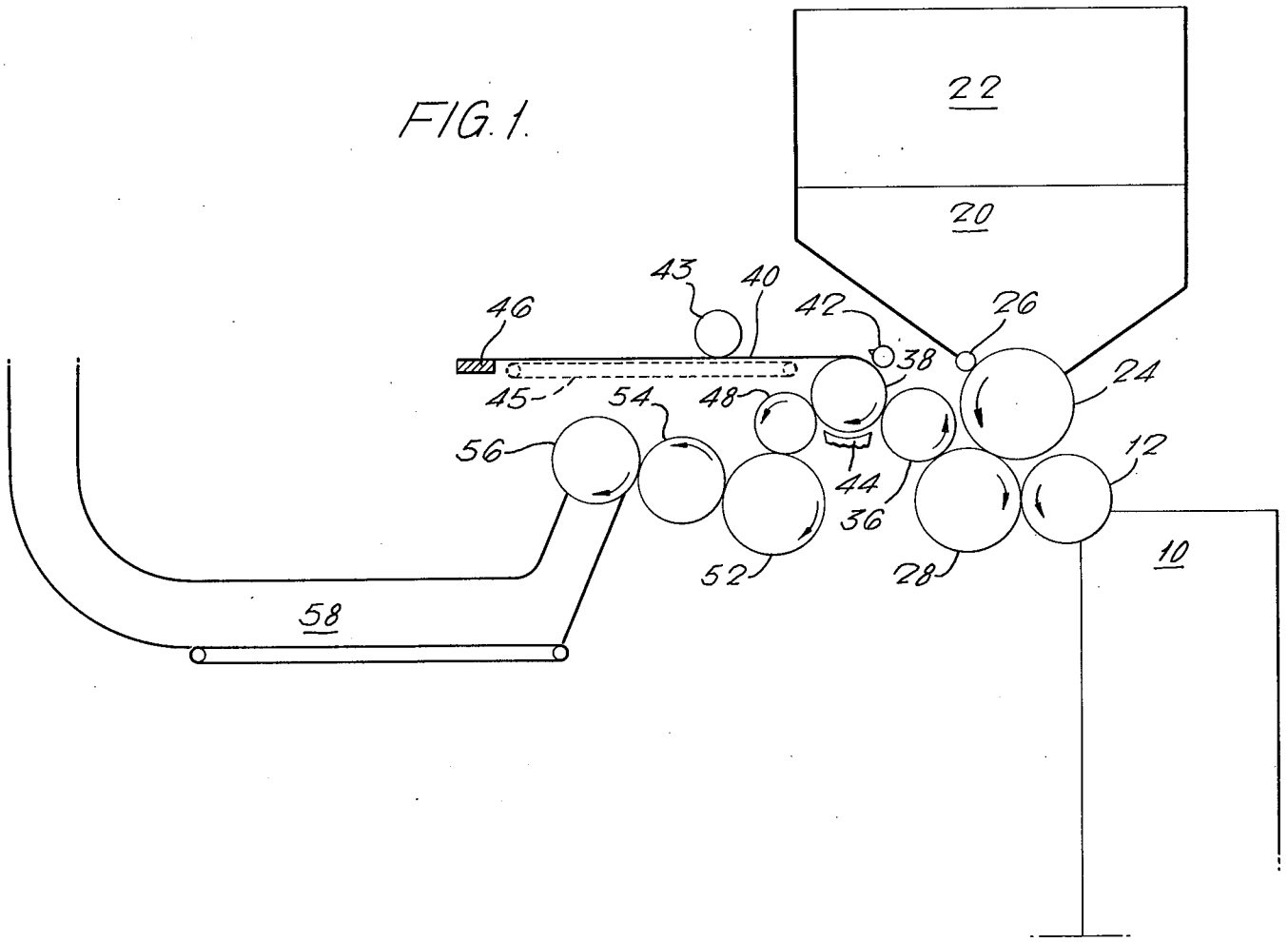
FIG. 1 is a diagrammatic side elevation of apparatus for assembling filter cigarettes.
Figure 2:
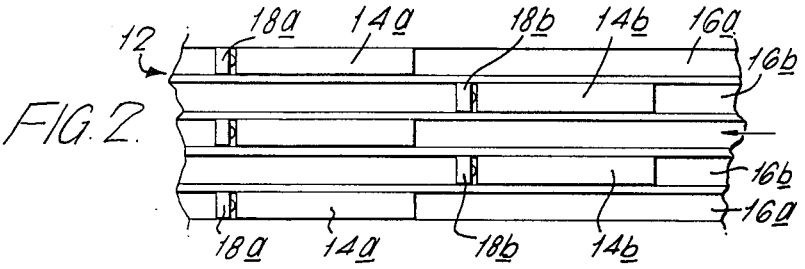
FIGS. 2 to 5 are respective plan views of parts of fluted drums in the apparatus of FIG. 1.

FIG. 1 shows a cigarette making machine bed 10 from which a line of endwise-moving tobacco sections are delivered into a rotating catcher drum 12. As can be seen from FIG. 2 alternate tobacco sections **14*a* and 14*b* are received in flutes 16*a* and 16*b* respectively which have stops 18*a* and 18*b* respectively positioned at different distances along the drum 12** so that a staggered formation of tobacco sections is obtained.

Figure 3:
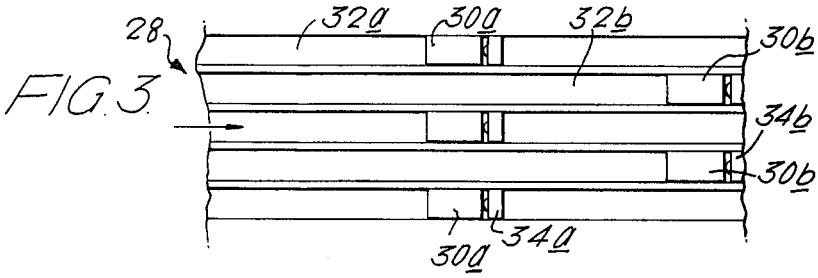

Referring once again to FIG. 1 a hopper 20 is arranged to receive filter rod lengths from a tray 22. The filter rods, which may be six times the length of an individual filter portion, are delivered into flutes of a drum 24 at the base of the hopper, on which drum they are cut into individual filter portions by rotary knives such as that shown at 26. As will be explained in more detail later a line of endwise-moving filter portions for delivery to a further drum 28 is formed by stripping successive flutes of the drum 24. Alternate filter portions 30*a* and 30*b* (FIG. 3) are received on drum 28 in flutes 32*a* and 32*b* respectively having stops 34*a* and 34*b* positioned so that a staggered formation of filter portions is obtained.

Figure 4:
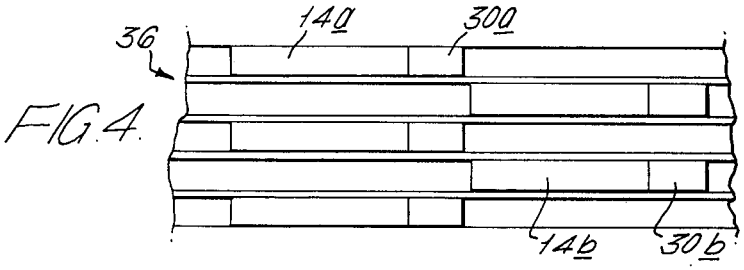

The staggered formation of tobacco sections is delivered to the drum 28 from the drum 12 so that the tobacco sections 14*a* occupy the flutes 32*a* alongside the filter portions 30*a* and the tobacco sections 14*b* occupy the flutes 32*b* alongside the filter portions 30*b.* Subsequently the assemblies are transferred to an ends closure drum 36 where the individual components in each flute are accurately aligned and brought into abutment (as by inclined guide surfaces). The position of the components in the drum 36 is shown in FIG. 4.

The assemblies 14*a,* 30*a* and 14*b,* 30*b* are each transferred from the drum 36 to a suction rolling drum 38 where each assembly is formed into a filter cigarette by wrapping a uniting band around the junction of the tobacco section 14 and the filter portion 30. The uniting bands are formed from two substantially parallel spaced strips 40 of wrapper material fed to the drum 38 and cut into lengths of uniting band by a pair of rotary knife carriers 42. One or more pasters 43 is provided to apply adhesive to the upper surfaces of the strips 40. The suction rolling drum 38 cooperates with a rolling plate 44 (which may comprise a pair of rolling plates in parallel, one for each of the assemblies *a* and *b*) to wrap a uniting band around each assembly to form a filter cigarette. Details of a rolling operation using a rolling drum and a rolling plate, whereby rod-like articles in axial abutment are joined, are disclosed in British Patent Specification No. 886,657.

The two parallel spaced strips 40 supplied to the rolling drum 38 may be obtained from a single web by use of turner bars, as indicated at 46, substantially as disclosed in U.S. patent application Ser. No. 672,148. A full description of this arrangement and various possible modifications is included in said application, to which reference is directed.

Figure 8:
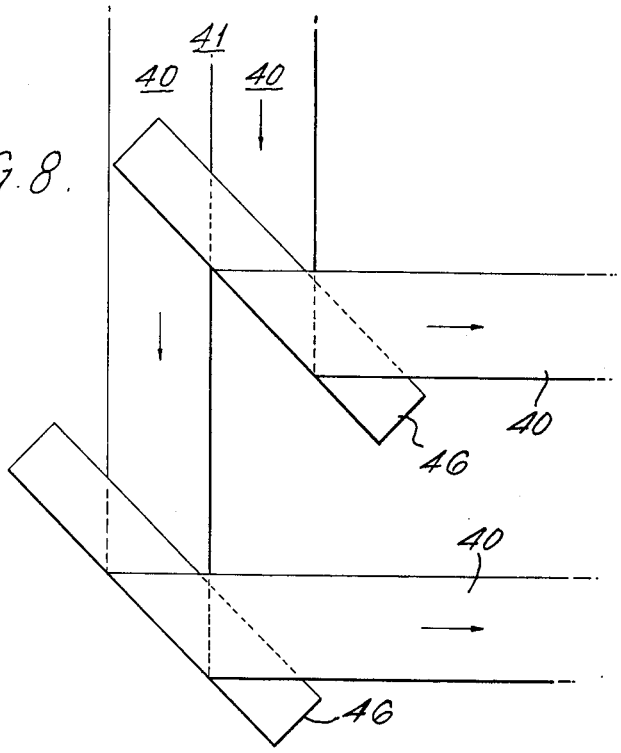
FIG. 8 is a detail plan view of part of the apparatus of FIG. 1.

The strips 40 are produced from a single web 41 of wrapper material as indicated in FIG. 8. The web 41 is fed through a rotary knife which continuously slits the web longitudinally into two strips 40. These strips are fed individually around parallel turner bars 46, which are spaced in the direction of movement of the strips so that the strips are spaced laterally by a predetermined amount after turning. FIG. 1 shows the turner bars diagrammatically at 46 and also shows the position of a removable suction band conveyor 45, which is used for setting up the strips 40 between the turner bars and the rolling drum 38 and may be moved away as by a hinged mounting after the strips have been tensioned by the rolling drum.

The web 41 and strips 40 are fed at a controlled speed which is less than the peripheral speed of the rolling drum 38. The strips 40 ar disposed in alignment with the junctions of the assemblies 14*a,* 30*a* and 14*b,* 30*b* fed between the drum 38 and the rolling plate 44. As already mentioned a pair of rotary knife carriers 42 is provided to divide the strips 40 into uniting bands. These bands are spaced circumferentially on the drum 38 by the differential speed of the drum and the strips 40. Each band is carried on the drum 38 by suction until it contacts an assembly between the rolling plate 44 and the drum, where the band is wrapped around the assembly to join the filter portion to the tobacco section.

Instead of relying on a paster 43 to apply adhesive to the upper surfaces of strips 40 the web 41 could be pregummed with a hot-melt adhesive. Preferably this adhesive would be allowed to cool prior to the slitting of the web and reactivated by a heater associated with the rolling drum 38. If a pastor such as 43 is not required the turner bars 46 can be brought closer to the rolling drum 38 so that fewer problems would be involved in setting up or threading prior to starting the apparatus. A suction band or roller may be used adjacent the rolling drum 38 in order to maintain or ensure correct alignment of the strips being fed onto the rolling drum.

Figure 5:
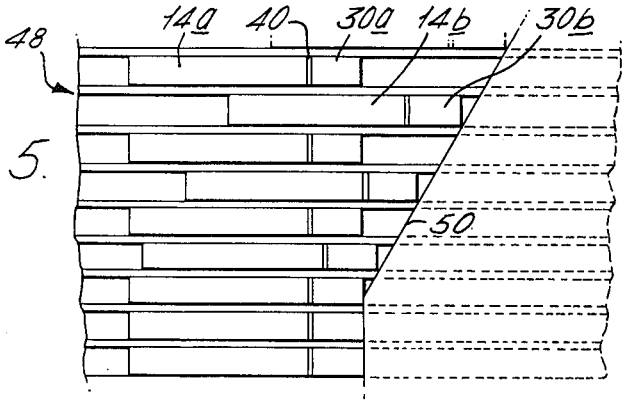

After rolling, the filter cigarettes are passed to a furthe fluted drum 48 (FIG. 1) which carries them past an inclined guide surface 50 (FIG. 5) so that the two rows of cigarettes are brought into alignment. Subsequently the cigarettes are transferred, via another drum 52 to the drums 54, 56 of a cigarette inspection device. Satisfactory cigarettes are conveyed away as a stack 58 for delivery to a cigarette packing machine.

Figure 6:
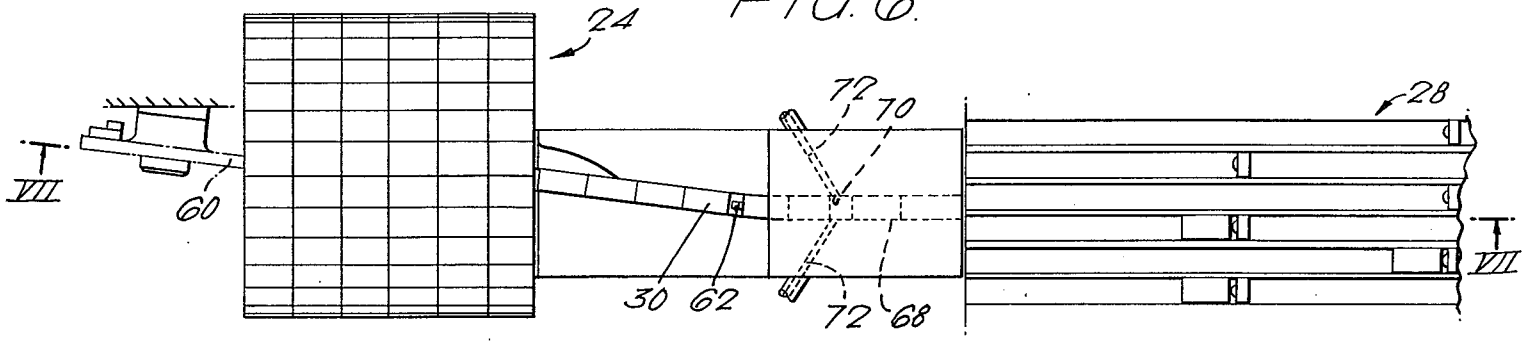
FIG. 6 is a plan view of apparatus for delivering filter portions.
Figure 7:
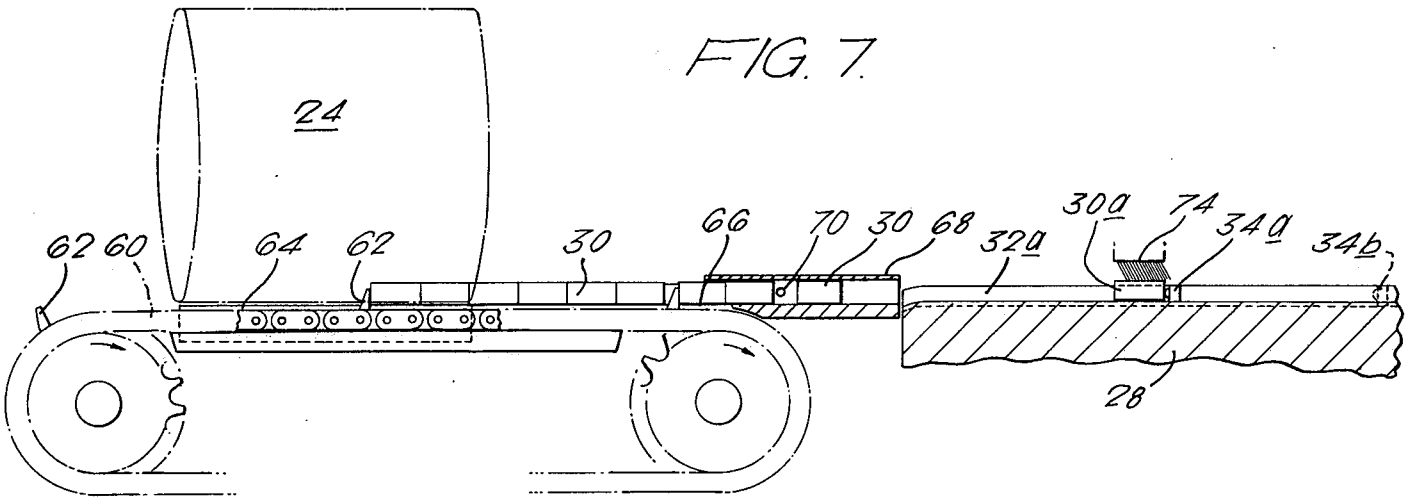
FIG. 7 is a longitudinal sectional view on the line VII—VII of FIG. 6.

The apparatus for stripping filter portions from the drum 24 and delivering them in a line to drum 28 is shown in FIGS. 6 and 7. As already explained the drum 24 is fluted and receives filter rods which are cut into six individual filter portions by knives 26. A chain conveyor 60, provided with extending lugs or pusher-members 62, extends across and passes beneath the drum 24. Instead of a chain conveyor a composite plastics belt could be used. The conveyor 60 is inclined to the longitudinal axis of the flutes of drum 24 and is arranged to move at such speed relative to that of the drum, that a lug 62 can enter the lowermost flute at one end and pass througbh it whilst the drum is rotating. The lugs 62 are suitably spaced apart so that successive lugs enter and pass through successive flutes in turn.

Guide plates 64 and 66, FIG. 7, are provided to support and guide filter portions 30 which are pushed from successive flutes and fed endwise in line by the lugs 62. The plates are slotted to allow the lugs to extend upwardly through them. Further guide elements may be provided above or at the sides of the line of filter portions.

The conveyor 60 delivers the line of filter portions into a tubular member 68 which is provided intermediate its ens with ports 70 which communicate with compressed air nozzles 72. The supply of air is timed to convey individual filter portions out of the tube 68 and into successive flutes 32*a,* 32*b* of the adjacent drum 28. As has already been described the stops 34*a,* 34*b* in the flutes are staggered so that a staggered formation of filter portions is obtained on the drum 28.

The acceleration provided by the pressure air is rapid so that each filter portion is positively separated from the line and enters the correct flute. The slight gap which may occur in the line between groups conveyed by different lugs 62 is too small to affect the timing. In view of the speed at which the filter portions are supplied to the drum 28 it is advisable to provide an anti-recoil member for the stops 34: as shown this is in the form of a brush 74 with bristles inclined towards the stop as indicated. Alternatively a light pawl action could be used.

The apparatus shown in FIGS. 6 and 7 is somewhat similar to that described in detail in British Patent Specification No. 876,732. Various modifications suggested by the disclosure of said patent specification are applicable to the present apparatus. In particular, some form of timing element could be used to space and time the filter portions delivered by the conveyor 60 before projecting them into the flutes of drum 28. A spiral spacing drum could be used as a timing element.

In a conventional process for assembling filter cigarettes a double length filter portion is placed between and joined to two aligned tobacco sections by rolling in a wrapper section which spans the filter portion and overlaps onto the tobacco sections. Individual filter cigarettes are obtained by cutting at the mid-point of the resulting assemblage. The present method and apparatus has some advantages over that used for this conventional process.

A ring tipping method, such as the preferred present method, is capable of providing economics in materials. For example, with a conventional 85 mm filter cigarette the filter portion could have a 20 mm wrapper and be joined to the tobacco section with a 23 mm "cork" wrapper section using 23 mm of glue. For the same size of cigarette produced by a ring tipping method the filter portion can itself be wrapped in 20 mm of cork printed material and joined to the tobacco section with 7 mm of ring tipping (uniting band) material using 7 mm of glue.

Conventional wrapper sections are treated to prevent sticking to the lips. This adds cost and makes gluing more difficult due to the waterproof film. Since the uniting band of the present method should never contact the lips lower cost materials able to accept glue more readily can be used. Moreover, apart from the saving in cost from the reduction in quantity of glue used, the odour from the glue, which can be noticeable, is reduced. The inherent economies in ring tipping may permit the use of pre-gummed material, which would avoid operator attention to the pasting unit.

The cutting knives for the uniting bands should be quieter and wear longer than a conventional cutting knife because noise and wear are a function of pressure and pressure is reduced with total knife width.

The use of relatively narrow uniting bands which leave most of the filter portions exposed during the rolling operation can lead to easier and safer rolling since friction surfaces can be used for the filter portions as well as for the tobacco sections. In conventional systems the filter portion is shielded by the wide wrapper section on the drum which latter has to have a relatively smooth surface.

It is possible that a reduced cigarette inspection facility would be required with the present method since the improved rolling and gluing conditions should result in an increase in efficiency.

Further advantages of the present apparatus are that no final cut knife is required for dividing a cigarette assemblage including a double length filter portion, nor is a tip turner required since all the cigarettes are produced with the filter portions at the same end. There should be less waste caused by stopping and starting the apparatus, since the number of tobacco sections and filter portions in transit is less than with conventional machines.

Another advantage is that little, if any, pitch change will be required throughout the present apparatus. In a conventional machine the pitch, i.e. the distance between successive assemblies, is reduced on transfer from the catcher drum to an aligning drum, where successive tobacco sections are aligned by rolling, subsequently increased to prevent a wrapper on the rolling drum overlapping two assemblies, and finally reduced on exit from the machine. By taking alternate tobacco sections from the catcher drum and dealing with them in parallel until after the rolling drum, the need for these pitch changes can be avoided.

It is customary for cigarette manufacturers to print a brand identification on the tobacco section wrapper. This could be avoided by pre-printing the uniting band material; the need for accurate registration could be avoided by suitably arranging the periodic distance of the printing in relation to the circumference of the cigarette.

Apparatus similar to that shown in FIGS. 6 and 7 could be used in a process for producing filter cigarettes in which double length filter portions are aligned between two tobacco lengths and joined by rolling to form an assemblage, either conventionally with a wrapper section spanning the filter portion or with a pair of uniting bands as disclosed for example in British Patent Specification No. 1,019,092. **In one arrangement the double length filter portions are delivered from the hopper drum 24 in groups of three and conveyed by a chain or plastics belt to a tube for ejection by pressure air directly into the flutes of the catcher drum. The filter portions are blown into every other flute of the catcher drum from the opposite side to the tobacco sections and are stopped by the rear face of the upstream stop (i.e. stop 18*b*)** for the tobacco sections. The axial spacing on the catcher drum is such that the distance between the stops is greater than the combined length of one tobacco section and a double length filter portion. On transfer from the catcher drum to a cigarette aligning drum the downstream tobacco section is rolled backwards so that it is aligned with the double length filter portion and the upstream tobacco section. The assembly is then conveyed forward to the rolling drum for formation into a cigarette assemblage from which individual filter cigarettes are obtained by cutting the assemblage at its midpoint.

The ends of the flutes into which the filter portions are blown may have diverging side walls so that timing is slightly less critical and so that the converging air stream is collected by each flute for a slightly longer period. Since the filter portions are blown into every other flute only, any resultant reduction in the width of the ends of the intermediate flutes would not matter.

It has already been mentioned that an anti-recoil member may be used to reduce the effects of bounce as the filter portions are stopped in the flutes. Accurate axial positioning of the filter portions against their stops may be obtained by use of an inclined guide surface, preferably in combination with an anti-recoil member. The guide surface may be formed on a resilient metal strip which is placed adjacent the catcher drum at an angular position just after that at which the filter portions are received. The strip may be inclined so that it tends to push the filter portions onto their stops as they are conveyed past the catcher drum and may project into a slight recess around the drum, produced by reducing the depth of the side walls of the flutes for a short axial distance, so that the strip can engage the ends of the filter portions.

Figure 9:
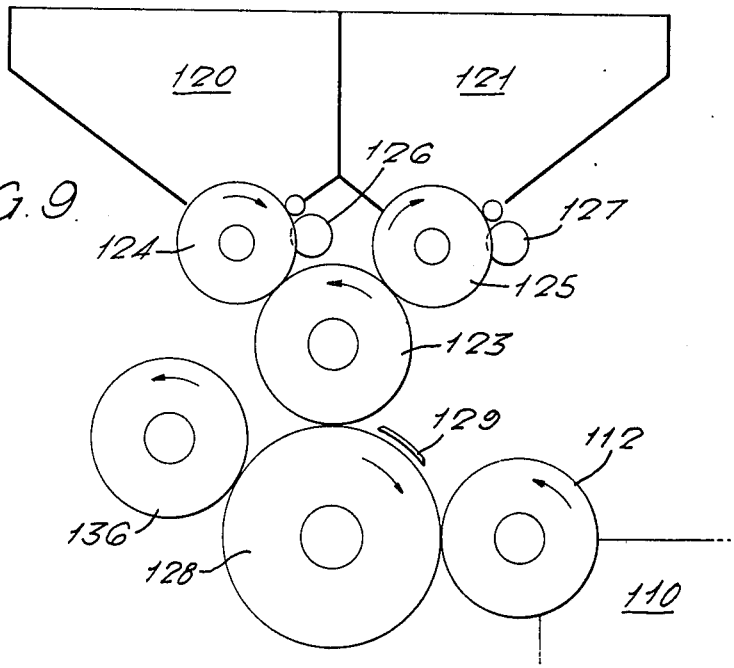
FIG. 9 is a diagrammatic side elevation of part of an apparatus for making Russian cigarettes.

Referring now to FIG. 9, which shows apparatus suitable for making Russian cigarettes, a cigarette making machine bed 110 supplies a line of endwise-moving tobacco sections into a rotating catcher drum 112. As can be seen from FIG. 10, alternate tobacco sections **114*a* and 114*b* are received in flutes 116*a* and 116*b* respectively which have stops 118 *a* and 118*b* respectively positioned along the drum 112 so that a staggered formation of tobacco sections is obtained. The apparatus shown in FIG. 9 corresponds to the part of the apparatus shown in the right hand portion of FIG. 1, the only difference in the apparatus of FIG. 9 so far described being that the sections 114***a* and 114*b* are shorter than the sections 14*a* and 14*b*, the former being of appropriate length for Russian cigarettes.

Referring once again to FIG. 9 two hoppers 120, 121 are arranged to receive double length mouthpiece tubes for the Russian cigarettes. The hoppers 120, 121 respectively feed fluted drums 124, 125 which carry the tubes past rotary knives 126, 127 to divide them at their mid-points into pairs of aligned single length tubes. A transfer drum 123 is arranged to receive the pairs of tubes from the drums 124 and 125, the pairs 130 from the drum 124 alternating with the pairs 131 from the drum 125 (FIG. 11). In order to receive pairs of tubes from the drums 124 and 125 the transfer drum 123 has a peripheral speed considerably higher than that of the drums 124 and 125. For example, the pitch spacing of the tubes on drum 124 or 125 may be 10 mm whereas that on transfer drum 123 between tubes received from the same drum may be 40 mm, i.e. 20 between each assembly as viewed in FIG. 11.

From the transfer drum 123 the pairs of tubes are transferred to a further drum 128 where each of the tubes 130*a* and 131*a* are rolled backwards by half a pitch, i.e. half the spacing between the pairs of tubes. This process is shown by FIG. 12 and a rolling plate 129 is indicated in FIG. 9. Whilst the tubes 130*a* and 131*a* are being rolled backwards the tubes 130*b* and 131*b* are engaged by inclined guide means 133 and shifted axially to space them away from the tubes 130*a* and 131*a*. Thus a staggered and spaced formation of tubes is obtained on the drum 128.

The staggered and spaced formation of tobacco sections as shown in FIG. 10 is delivered from the catcher drum 112 to the drum 128 at a position in relation to the drum 128 where relative movement of the tubes on the drum 128 has been completed. As shown in FIG. 13 the tobacco sections 114*a* are delivered alongside the left hand end of the tubes 130*a* and 131*a* whereas the tobacco sections 114*b* are delivered alongside the left hand end of the tubes 130*b* and 131*b*. Subsequently these assemblies are transferred to an ends closure drum 136 where the individual components in each flute are accurately aligned and brought into abutment (as by inclined guide surfaces).

The subsequent treatment of the assemblies to produce cigarettes may be described with respect to the apparatus of FIG. 1.

I claim:

1. A method of making filter cigarettes comprising assembling tobacco sections moving in a direction transverse to their lengths along two separate paths, the tobacco sections on one path being parallel to and transversely displaced relative to the tobacco sections on the other path; assembling filter portions moving in a direction transverse to their lengths along two separate paths, the filter portions on one path being parallel to and transversely displaced relative to the filter portions on the other path; moving said tobacco sections said filter portions along portions of said separate paths which are partially common, so as to produce two rows of transversely-moving tobacco sections having axially adjacent filter portions, the filter portions being at the same ends of the tobacco sections in each row in relation to the direction of movement of the rows; and uniting the axially adjacent filter portions and tobacco sections whilst they are moving transverse to their lengths.

2. A method as claimed in claim 1, wherein the tobacco sections and filter portions of one of said rows are in transversely displaced positions relative to the tobacco sections and filter portions in the other of said rows.

3. A method as claimed in claim 2, wherein said rows are combined into a single row of axially adjacent tobacco sections and filter portions prior to said uniting operation.

4. A method as claimed in claim 1, wherein the uniting operation is performed separately for each row.

5. A method as claimed in claim 4, comprising the steps of feeding a web of uniting material; continuously longitudinally slitting the web into two strips; feeding the strips around guide elements which are spaced in relation to the directions of travel of the strips so that said directions of travel are changed and the strips are spaced laterally apart; transversely cutting each strip into portions to provide uniting bands; and wrapping and sealing the uniting bands from one strip around the adjacent tobacco sections and filter portions of one of said rows and the uniting bands from the other strip around the adjacent tobacco sections and filter portions of the other of said rows, to unite said tobacco sections and filter portions in said rows.

6. A method as claimed in claim 5, wherein the uniting bands are wrapped around the adjacent end portions only of axially adjacent tobacco sections and filter portions.

7. A method as claimed in claim 1, wherein said tobacco sections are assembly by feeding axially onto said separate paths from a single source.

8. A method as claimed in claim 7, wherein said filter portions are assembled by feeding axially onto said separate paths from a single source.

9. A method as claimed in claim 8, wherein said tobacco sections and said filter portions are fed in mutually parallel and opposite directions.

10. A method as claimed in claim 1, wherein said filter portions are assembled on said separate paths by transversely feeding double length filter portions, dividing said portions at their mid-points to produce pairs of aligned filter portions, transversely displacing corresponding filter portions of each pair, and axially moving corresponding filter portions of each pair.

11. A method as claimed in claim 10, wherein one filter portion of each pair of transversely displaced and the other filter portion of each pair is moved axially.

12. Apparatus for making filter cigarettes, comprising conveyor means having spaced carrier members for receiving tobacco sections in transversely and axially offset positions and for moving said tobacco sections in a direction transverse to their lengths, conveyor means having spaced carrier members for receiving filter portions in transversely and axially offset positions and for moving said filter portions in a direction transverse to their lengths, said conveyor means for tobacco sections and said conveyor means for filter portions being arranged such that two rows of transversely-moving tobacco sections having axially adjacent filter portions may be conveyed, at least one cooperating rolling drum and rolling plate arranged to receive axially adjacent tobacco sections and filter portions from said conveyor means, and means for feeding uniting bands to the tobacco sections and filter portions to unite them by rolling and sealing a uniting band around their adjacent end portions.

13. Apparatus as claimed in claim 12 including means for feeding tobacco sections in an axial direction onto said conveyor means.

14. Apparatus as claimed in claim 13 including means for feeding filter portions in an axial direction onto said conveyor means.

15. Apparatus as claimed in claim 14 wherein said respective feeding means are arranged to supply tobacco sections and said filter portions at respectively opposite ends of the same conveyor means.

16. Apparatus as claimed in claim 12 including conveyor means for conveying double length filter portions in a direction transverse to their length, dividing means for cutting said portions at their mid-points to produce pairs of aligned filter portions, rolling means for transversely displacing corresponding filter portions of each pair, and quide means for axially moving corresponding filter portions of each pair, so that said filter portions may be delivered into said carrier members in transversely and axially offset positions.

17. Apparatus as claimed in claim 12 including means to feed a web of uniting material to the rolling drum, slitting means to slit the web continuously longitudinally into two strips, spaced guide means for changing the direction of travel of said strips and for laterally spacing the strips apart, and means for successively cutting portions from the strips to provide a plurality of uniting bands.

* * * * *